United States Patent [19]

Coleman

[11] 3,930,319

[45] Jan. 6, 1976

[54] DRYING APPARATUS

[75] Inventor: John Douglas Coleman, Surrey Hills, Australia

[73] Assignee: Commonwealth Scientific and Industrial Research Organization, Campbell, Australia

[22] Filed: Dec. 4, 1974

[21] Appl. No.: 529,583

[30] Foreign Application Priority Data

Dec. 10, 1973 Australia .....5935/73
Aug. 23, 1974 Australia .....8645/74

[52] U.S. Cl. ..... 34/122; 34/114; 34/155
[51] Int. Cl.[2] ..... F26B 13/08
[58] Field of Search ..... 34/122, 114, 159, 229, 34/160, 155; 15/399, 405; 239/559, 567

[56] References Cited

UNITED STATES PATENTS

| | | | |
|---|---|---|---|
| 3,003,177 | 10/1961 | Hijiya | 34/229 X |
| 3,052,991 | 9/1962 | Goloner | 34/114 X |
| 3,176,412 | 4/1965 | Gardner | 34/122 |
| 3,263,341 | 8/1966 | Allen | 34/229 X |

FOREIGN PATENTS OR APPLICATIONS

| | | | |
|---|---|---|---|
| 674,969 | 4/1939 | Germany | 34/122 |
| 1,157,356 | 11/1963 | Germany | 15/399 |

*Primary Examiner*—William F. O'Dea
*Assistant Examiner*—Harold Joyce
*Attorney, Agent, or Firm*—Cushman, Darby & Cushman

[57] ABSTRACT

Apparatus for drying a travelling web, particularly a paper web. A hot air delivery structure is mounted adjacent the periphery of a steam heated cylinder to direct jets of hot air against travelling web supported on the cylinder. At least part of hot air delivery structure is moveable transversely of the cylinder periphery and the jets of hot air produce a surface effect to hold air delivery structure away from engagement with the web. Movement of hot air delivery structure is preferably achieved by flexure of that structure.

17 Claims, 9 Drawing Figures

DRYING APPARATUS

BACKGROUND OF THE INVENTION

1. Field of the Invention

This invention provides an apparatus for drying a travelling web which may, for example, be a web of paper or paperboard.

2. Description of the Prior Art

The introduction of various new methods of forming paper and board in the last ten years has led to significant increases in paper machine speed and it is now possible to manufacture paper at more than twice the speeds achieved previously using traditional forming methods. Significant improvements in press design have been made over the corresponding period as the machine speed increased but the moisture content of the fibre web entering the dryers has not changed appreciably. Greatly increased demands are therefore made on the dryer section, especially in the manufacture of paperboards, and the cost of the increased number of steam heated cylinders together with the extended building and ancilliaries has become a major capital item. Further, in many older machines, the full benefit of rebuilding the pressing and forming section cannot be realized due to drying limitations.

Much effort has been expended in attempts to develop drying techniques to supplement or replace the steam heated cylinders. The list would include sectional and pocket ventilation, high velocity air impingement hoods, and plenums acting against the unsupported sheet, radiant and high frequency systems, vacuum and through drying techniques, fluidized bed and low melting point alloy systems.

These various techniques are well documented and it is fair to say that none are as satisfactory, overall, as the steam heated cylinder when properly ventilated. Condensate removal systems for cylinders have kept pace with machine speed increases and the economics of simultaneous power and steam generation is such that cylinder drying is not equalled by any alternative system except perhaps by the Papridrier, which is not yet proved for heavier paperboard manufacture. The various alternatives have only found limited application, to supplement output where costing is on a marginal basis, to eliminate moisture streaks, dry paper coatings and exploit any anomalies in fuel costs. For lightweight papers the air impingement hood is often employed in conjunction with a Yankee cylinder.

The prospects for advance in drying technology seem to be best where the process is based on the present conventional steam cylinder system.

Many aspects of the drying mechanism on the cylinder are still debated. However, it is indisputable that less than half the board surface is in contact with the cylinders at any time. It is equally certain that air impingement onto the remaining available surface will significantly increase the rates of evaporation. The extent depends on a number of factors, in particular the thickness of the board. In practice, however, air impingement is more difficult and expensive to arrange on multi cylinder dryers than say on a Yankee tissue machine where only one large cylinder is usually employed. Firstly, a whole series of hoods are required which are costly and occupy much space and the broke arising from breaks in the sheet accumulating in each hood can have a disastrous effect on machine efficiency. Attempts to use impingement dryers on individual steam cylinders of paperboard machines have been largely abandoned for the above reasons.

In principle, the air impingement technique remains attractive since evaporation rates of 2 to 8 times the rate for cylinders alone can be achieved. The present invention provides an apparatus which enables air impingement to be achieved without the mechanical and other limitations of fixed air impingement hoods.

SUMMARY OF THE INVENTION

According to the invention there is provided apparatus comprising a web support structure having a surface on which to support a travelling web and a hot air delivery structure mounted adjacent the web support structure to direct hot air against the supported web, wherein at least part of the hot air delivery structure is movable transversely of said surface and the hot air delivery structure is formed to direct air against the supported web so as to produce a surface effect which holds that structure away from engagement with the web.

The air which produces the surface effect may comprise all or part of the hot air for drying the web.

The web support structure may be a rotary cylinder and said surface may be the peripheral surface of the cylinder.

The hot air delivery structure may then have a hot air chamber bounded on one side by a curved wall which extends around the peripheral wall of the cylinder and is perforated to produce jets of hot air directed against the web. Some or all of these jets may produce the surface effect to hold the structure out of engagement with the web.

The delivery structure could be rigid and supported on mounting means permitting it to move as a whole transversely of the cylinder wall. However it is preferred that the air delivery structure be capable of flexing transversely of the cylinder wall and that the clearance between it and the cylinder wall be held by such flexure.

In order that the invention may be more fully explained some exemplary constructions will be described with reference to the accompanying drawings.

DESCRIPTION OF THE PREFERRED EMBODIMENT

Figure 1:
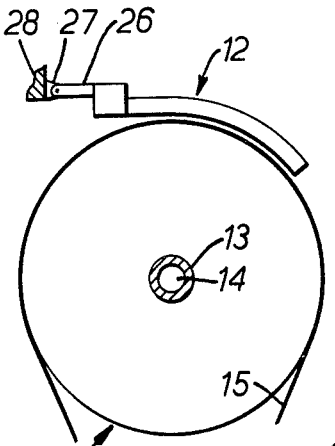
FIG. 1 illustrates diagramatically a dryer cylinder fitted with a hot air delivery structure in accordance with the invention.
Figure 3:
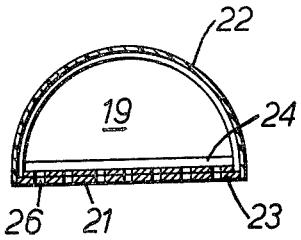
FIG. 3 is a cross-section on the line 3-3 in FIG. 2.
Figure 2:
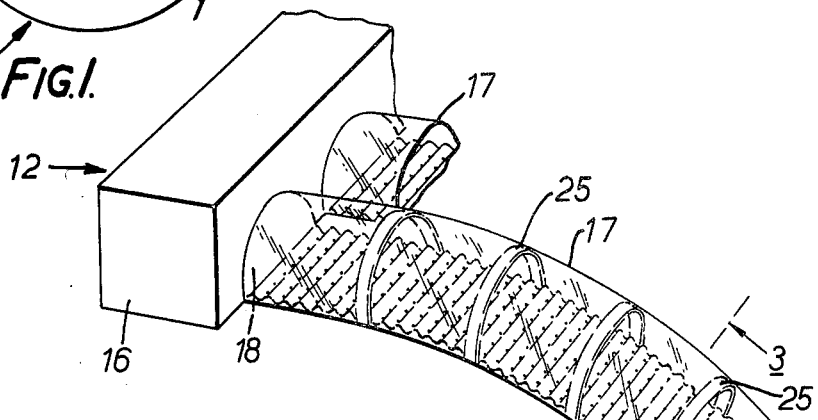
FIG. 2 is a broken perspective view of the hot air delivery structure.

FIGS. 1 to 3 illustrate a heated cylinder 11 fitted with a hot air delivery structure 12 in accordance with the invention. Cylinder 11 is of conventional construction comprising a large diameter hollow cast steel cylinder mounted for rotation on a shaft 13. The interior of the cylinder receives steam through a passage 14 within shaft 13 whereby the wall of the cylinder is heated to cause drying of a paper web 15 which is wrapped around it.

Hot air delivery structure 12 comprises a long header member 16 of rectangular cross-section and a plurality of elongate arms 17 extending transversely from the header member. Header member 16 extends across an upper part of the peripheral surface of cylinder 11 and arms 17 extend circumferentially over and around that upper part of the peripheral surface of the cylinder at regular intervals across it.

Each arm 17 is connected at one end to header member 16 so as to be cantilever supported from it. The header member is supported on an arm 26 hinged at 27 to a fixed mounting 28 so that the whole structure 12 is supported in the illustrated position relative to the cylinder during normal operation but can swing away from the cylinder to clear any foreign material which might be fed beneath it. Structure 12 can also be swung away from the cylinder during threading up. When supported in its normal position structure 12 forms with the cylinder an entrance throat 29 for the paper web 15.

The construction of air delivery structure 12 can best be seen in FIGS. 2 and 3. Header member 16 is formed as a rectangular sheet metal casing enclosing a header duct and having openings 18 in one side wall to provide communication between the header duct and the hollow interiors 19 of arms 17. The hollow interior 19 of each arm 17 serves as a hot air chamber to which hot air is delivered via the header duct. This chamber is bounded at one side by a wall 21 which faces the peripheral wall of cylinder 11 and is connected at its periphery to a back wall 22 completing the chamber enclosure. Wall 21 is formed by a sole plate 23 backed by a corrugated reinforcing plate 24, the corrugations of which extend transversely of the arm structure. Wall 22 is of generally semi-cylindrical formation. It is made of a flexible plastics material and has circumferential pleats 25 at regular intervals along its length so that it is extendible and does not inhibit flexure of the arm 17 as a whole. Wall 21 is reinforced by the corrugated plate 24 against lateral flexure but it can flex to a considerable extent in the longitudinal direction of arm 17 so as to vary the curvature of the arm such that it is urged toward the peripheral wall of cylinder 11 when internal pressure is applied.

The walls 21 of arms 17 are perforated by holes 26 so that hot air can issue from chambers 19 as series of jets directed downwardly onto that part of the paper web which is wrapped on the upper part of the peripheral wall of cylinder 11. These jets react against the paper covered wall of the cylinder to produce a surface effect similar to that generated by ground effect vehicles whereby arms 17 are held out of engagement with the paper web. There is thus created beneath each arm 17 a shallow clearance space from which the hot air escapes laterally downwardly and this clearance space is maintained by the cushion of hot air which is sustained by the air issuing through jet holes 26. There is considerable turbulence in the air cushion which promotes effective drying over the whole of the surface of the paper web beneath arms 17 in addition to the direct impingement effect of the air jets. Arms 17 "float" on the paper web without friction and the arrangement is self clearing since the arms will rise to clear obstructions on the cylinder. Arms 17 may be flexible enough to conform to cylinders of a wide range of diameters and delivery structure 12 can therefore be mass produced to a standard design and size.

Figure 4:
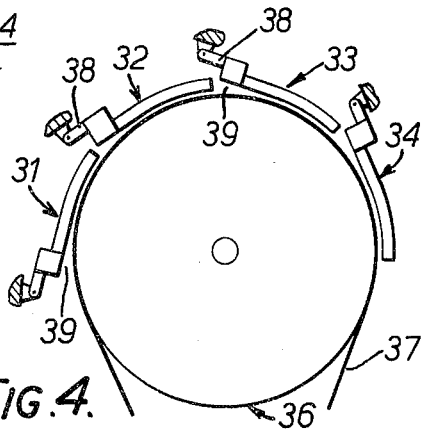
FIG. 4 illustrates diagramatically a dryer cylinder fitted with a plurality of hot air delivery structures in accordance with the invention.
Figure 6:
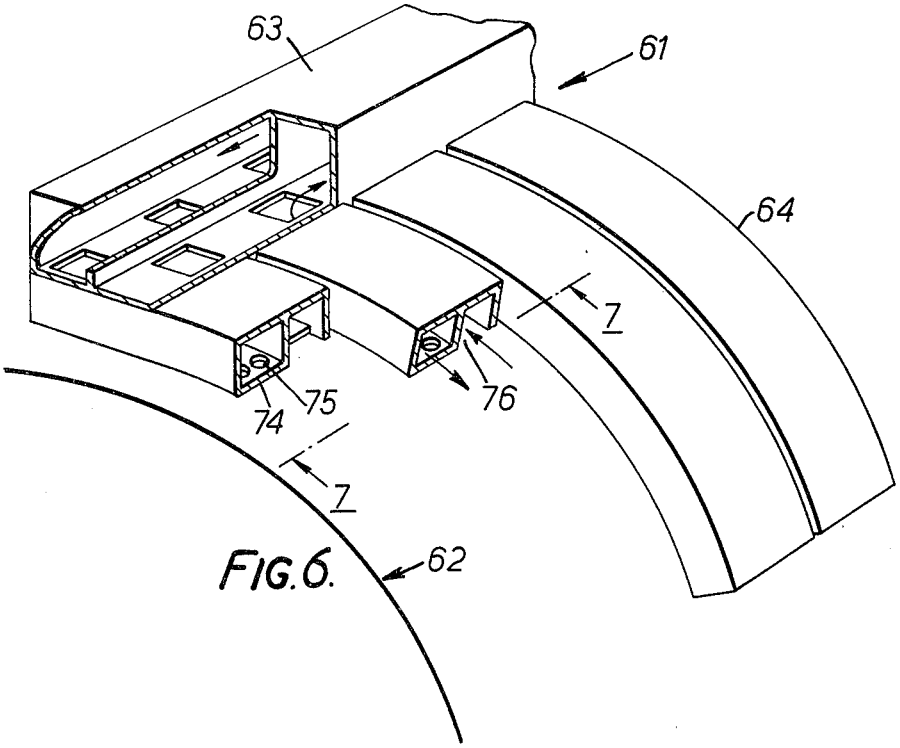
FIG. 6 is a broken away perspective view of an alternative form of hot air delivery structure constructed in accordance with the invention.
Figure 7:
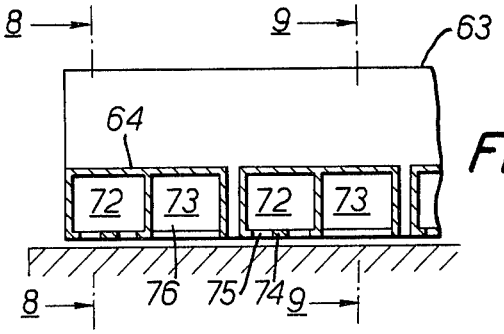
FIG. 7 is a cross-section on the line 7-7 in FIG. 6.
Figure 8:
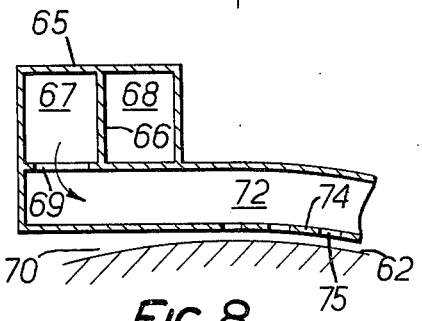
FIG. 8 is a cross-section on the line 8-8 in FIG. 7.
Figure 9:
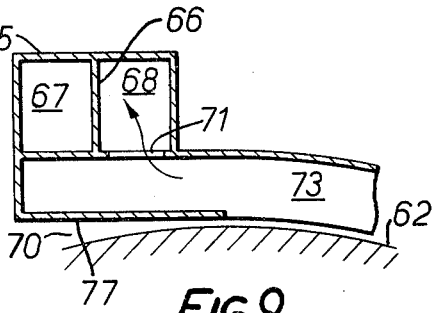
FIG. 9 is a cross-section on the line 9-9 in FIG. 7.

In some cases a plurality of hot air delivery structures may be fitted to a single cylinder for example, an MG cylinder. Such an arrangement is illustrated in FIG. 4 which shows a plurality of hot air delivery structures 31,32,33,34 fitted around a single heated cylinder 36 wrapped by a paper web 37. The hot air delivery structures 31,32,33,34 may each be constructed and operated in the same manner as structure 12 of the previous embodiment and may be mounted on hinge arms 38 so that during normal operation they are supported so as to form throats 39 with the cylinder surface.

Figure 5:
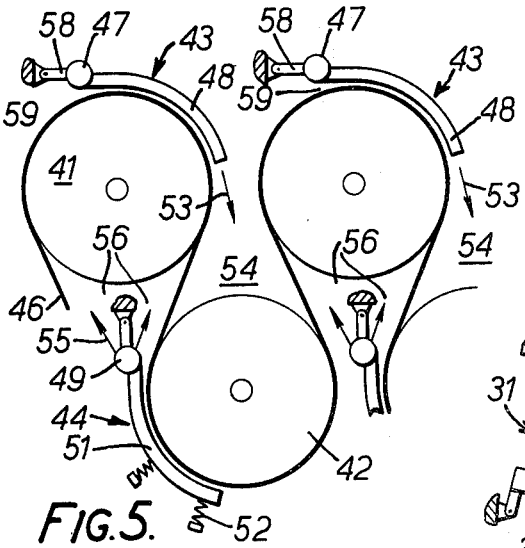
FIG. 5 illustrates diagramatically a dryer section comprising a number of heated cylinders each fitted with a hot air delivery structure in accordance with the invention.

FIG. 5 illustrates an arrangement in which the upper heated cylinders 41 and lower heated cylinders 42 of a drying stage are provided with hot air delivery structures 43,44 in accordance with the invention. Cylinders 41,42 are arranged conventionally and in fact may form part of a conventional drying stage to which hot air structures 41,42 have been added. In use of the apparatus paper web 46 is wrapped around the cylinders in serpentine fashion.

Hot air delivery structures 43 comprise header members 47 mounted adjacent the upper peripheral surfaces of cylinders 41 and arms 48 which are cantilever supported from header members 47 and extend over and around the upper parts of the cylinders. Header members are supported on hinge arms 58 to form throats 59 with the cylinders. Arms 48 are generally of the same construction as the arms 17 of the embodiment illustrated in FIGS. 1 to 3 and their walls facing cylinders 41 are perforated so as to provide jets of hot air which are directed against the paper web wrapped around those cylinders thereby creating air cushions to hold the arms away from the cylinders. Hot air delivery structures 44 have header members 49 and arms 51 cantilever supported from the header members. They are constructed in the same manner as structures 43 and are similarly mounted on hinge arms 60. However, since their arms 51 hand downwardly from header duct structures 49 biasing springs 52 are provided to bias the arms toward cylinders 42. The cushions formed by the jets of hot air directed from the arms 51 against the paper wrapped cylinders 42 act against biasing springs 52 to maintain a small clearance space between the arms and the web.

As the width of paper machines has increased it has become necessary to forcibly ventilate the space between the dryer cylinders since high humidity in this region retard evaporation. Pipes can be used to direct air evenly across the machine but are prone to interfere with the operation of the machine in much the same way as a fixed drying hood. Jets of air directed inwardly from the sides of the machine are also used but can lead to uneven moisture levels across the finished roll of paper. By introducing air directly across the machine through jets fixed to or formed in the hot air delivery structures of the present invention uniform, trouble-free operation can be achieved. These jets may be formed in the outer walls of the delivery structure and may be located at or toward the tips or toes of those structures. One particular arrangement is indicated in FIG. 5 in which the arrows 53 represent hot air jets issuing from the outer ends of arms 48 to ventilate the spaces 54 and arrows 55 represent hot air jets directed upwardly through holes in header members 49 of structures 44 to ventilate the spaces 56.

FIGS. 6 to 9 illustrate an alternative embodiment of the invention comprising a hot air delivery structure 61 mounted adjacent the upper part of a heated paper support cylinder 62. Structure 61 comprises a fixed header member 63 extending across the periphery of cylinder 62 so as to form a throat 70 and a plurality of curved somewhat flexible arms 64 cantiliver supported from the header member to extend circumferentially around an arc of the cylinder wall. Arms 64 are closely spaced across the cylinder and as explained below they are constructed so that they not only deliver hot air through jets to form air cushions but they also collect and re-cycle air from the cushions.

Header member 63 is comprised of an elongate casing 65 of rectangular cross-section divided internally by vertical partition wall 66 so as to define two longitudinal ducts 67,68. Duct 67 serves to deliver hot air to the two arms 64 via ports 69 formed in its floor and duct 66 serves as a return air duct which receives collected hot air from arms 64 via ports 71 formed in its floor.

Arms 64 are generally of rectangular cross-section and each is divided longitudinally so as to have at one side a hot air delivery chamber 72 and at the other side an air collection duct 73. The bottom of hot air chamber 72 is closed by a wall 74 facing the peripheral surface of cylinder 62 and perforated by holes 75. It receives hot air from delivery duct 67 of header structure 63 via ports 69 and delivers that air in the form of jets issuing through holes 75 against a paper web supported on cylinder 62 so as to create a surface effect in the same manner as in the previous embodiment. Arms 64 may be constructed of plastics material so as to be sufficiently flexible to flex transversly of peripheral wall of the cylinder and to be held away from the paper web by the air cushions created by the hot air jets. Return air ducts 73 are generally channel shaped with open mouths 76 facing the paper web throughout the major part of the length of the arms. However in the region where arms 64 are connected to header member 63 these collection ducts are closed by a bottom wall portion 77 to ensure that all of the collected air is drawn back through ports 71 into return duct 68.

Air delivery structure 61 may be supported on one or more hinge arms (not shown) as in the previous embodiments to enable it to clear obstructions and to be swung away for threading operations.

In use of the apparatus illustrated in FIGS. 6 to 9 the duct 67 of the header structure 63 is connected to a hot air supply line fitted with some form of heating means. Gas fired heating or steam heating would generally be used. The hot air jets issuing from holes 75 sustain air cushions which hold the arms out of engagement with the paper web. Hot air escapes laterally outwardly from these cushions and is sucked back to circulating fan through the collection channels 73 of arms 64 and the return duct 68 of header member 63.

The hot air delivery structures of the present invention can be produced quite cheaply and are simple to install. They may be used to supplement existing steam cylinder dryers so as to increase their effectiveness and they can be used in modern machines fitted with open weave drying fabric. They also enable arrangements by which it is possible to achieve controlled variations in drying rate across the width of the web. By providing a series of arm-like hot air delivery structures across the web the drying rate at any particular part of the web can be varied by moving the delivery structures to appropriate positions across the web or by varying the supply of hot air to move some of the structures relative to the others.

The illustrated embodiments of the invention have been advanced by way of example only and they could be varied considerably. For example, in order to promote the surface effect to hold the air delivery structure out of engagement with the web, some of the holes from which the air jets issue may be grouped in raised pads on the perforated wall of the delivery structure and may be of a different size from the remainder of the holes which will then deliver air for drying purposes only. It would also be possible to have separate air supplies for the surface effect jets and the drying jets. Although the form of air delivery structure which comprises one or more elongate arms is preferred it would be possible to provide a relatively wide air delivery structure extending across the cylinder with spaced openings for escape or for collection and re-cycling of hot air. Moreover it would be possible to provide a rigid air delivery structure and support this on mounting means permitting it to move as a whole transversely of the cylinder wall under the influence of the surface effect created by the air jets.

It should also be appreciated that the invention is not limited in application to the drying sections of paper forming machinery and could be applied in other cases where a moving web must be dried. Apparatus constructed in accordance with the invention could, for example, be used for drying a web of paper or other material which has been printed, dyed or coated. Particularly in such applications the web support structure need not necessarily be cylindrical. It could have, for example, a flat web support surface with the hot air delivery structure being shaped to suit. It is accordingly to be understood that the invention is not limited to the illustrated apparatus and that many variations will fall within the scope of the appended claims.

We claim:

1. Apparatus for drying a travelling web, comprising a web support structure having a surface on which to support a travelling web and a hot air delivery structure mounted adjacent the web support structure to direct hot air against the supported web, wherein at least part of the hot air delivery structure is movable transversely of said surface and the hot air delivery structure is formed to direct air against the supported web so as to produce a surface effect which holds that structure away from engagement with the web.

2. Apparatus as claimed in claim 1, wherein the hot air delivery structure is capable of flexing transversely of said surface and in use of the apparatus the surface effect maintains clearance between it and the web by such flexure.

3. Apparatus as claimed in claim 2, wherein the hot air delivery structure tends to engage said surface by flexure under the influence of its own weight.

4. Apparatus as claimed in claim 2, wherein there is biasing means acting on the hot air delivery structure so as to tend to cause it to engage the said surface by flexure of that structure.

5. Apparatus as claimed in claim 1, wherein said web support structure is a rotary cylinder and said surface is the peripheral surface of the cylinder.

6. Apparatus as claimed in claim 5, wherein the hot air delivery structure defines a hot air chamber bounded on one side by a curved wall which extends around the peripheral wall of the cylinder and is perforated to form jets of hot air directed toward said surface thereby to produce said surface effect.

7. Apparatus as claimed in claim 6, wherein the hot air delivery structure tends to mould itself against the cylinder under the influence of the internal pressure generated when hot air is delivered through it.

8. Apparatus as claimed in claim 1, wherein the hot air delivery structure includes air collection means to collect air which has been directed against the supported web to produce said surface effect.

9. Apparatus as claimed in claim 8, wherein the air collection means comprises a channel with an open mouth facing the surface of the web support structure.

10. Apparatus as claimed in claim 1, wherein the hot air delivery structure is comprised of an arm cantilever supported at one end to extend adjacent said surface of the web support structure and enclosing an air chamber and an air supply duct connected to the chamber within the arm; said chamber having a wall facing said surface of the web support structure and perforated by holes to form jets of air directed against the supported web and being capable of flexing transversely of said surface such that in use of the apparatus the surface effect maintains clearance between the web and the arm by such flexure.

11. Apparatus as claimed in claim 10, wherein the said arm further comprises a longitudinally extending channel with an open mouth facing the surface of the web support structure to collect air from said jets.

12. Apparatus as claimed in claim 11, wherein said channel extends along one side of the arm and the perforated wall of the chamber extends along the other side of the arm.

13. Apparatus as claimed in claim 10, wherein the air supply duct is defined by a rigid header structure and the arm is cantilever supported from that header structure.

14. Apparatus as claimed in claim 13, wherein said arm is one of a plurality of similar arms each cantilever supported from said header structure and each having an interior connected to said air supply duct.

15. Apparatus as claimed in claim 10, wherein said web support structure is a rotary cylinder and said surface is the peripheral surface of the cylinder.

16. Apparatus as claimed in claim 15, wherein the hot air delivery structure is one of a plurality of similar structures spaced circumferentially of the cylinder.

17. Apparatus as claimed in claim 15, wherein said cylinder is one of a plurality of cylinders around which to wrap a web in serpentine manner and the hot air delivery structure is one of a plurality of such structures fitted one to each of the cylinders and wherein the hot air delivery structures are provided with holes additional to those in the walls of the arms which face the peripheral walls of the cylinders to form auxiliary jets of hot air directed into spaces between the cylinders.

* * * * *